United States Patent [19]

Paillere et al.

[11] Patent Number: 4,838,933

[45] Date of Patent: Jun. 13, 1989

[54] APPARATUS FOR MELTING AND CONTINUOUS CASTING OF METALS, THE PROCESS INVOLVED AND USE OF THE APPARATUS

[75] Inventors: Patrick Paillere; Edouard Alheritiere, both of Ugine; Marcel Garnier, Uriage; Jean Driole; Annie Gagnoud, both of Grenoble, all of France

[73] Assignee: Compagnie Europeenne Du Zirconium Cezus, Courbevoie, France

[21] Appl. No.: 142,205

[22] Filed: Jan. 11, 1988

[30] Foreign Application Priority Data

Jan. 15, 1987 [FR] France ..... 87 00814

[51] Int. Cl.[4] ..... C22B 4/00

[52] U.S. Cl. ..... 75/10.14; 75/65 R; 164/68.1; 373/157

[58] Field of Search ..... 75/10.14, 65 R; 164/68; 373/157

[56] References Cited

U.S. PATENT DOCUMENTS 3,775,091 11/1973 Clites ..... 75/65 R 4,432,093 2/1984 Reboux ..... 373/157

*Primary Examiner*—Peter D. Rosenberg

*Attorney, Agent, or Firm*—Dennison, Meserole, Pollack & Scheiner

[57] ABSTRACT

Apparatus for melting and continuously casting metals, comprising a vertical, conductive cold crucible (1) with at least part of the height of its wall in the form of longitudinal sectors (2) which are electrically insulated from one another and have a cooling fluid running through them; an inductor (6) with coils helically surrounding the crucible (1) over part of its height and supplied with alternating current both for heating and confining the metal; a system for drawing down the ingot; and possibly a chamber with a controlled external atmosphere, separating at least the contents of the crucible (1) from the external atmosphere, characterized in that the crucible (1) has an upper zone (4) divided into sectors, with parallel vertical generating lines, and a lower zone (5) divided into sectors and joined to the upper zone (4), the generating lines of the lower zone spreading apart in a downward direction from the join (45) between the two zones (4 and (5), and that the lowest coil (60) of the inductor (6) is at the level of that join (45). The apparatus of the invention is advantageously used for melting and casting refractory metals and other materials.

11 Claims, 1 Drawing Sheet

FIG. 1a
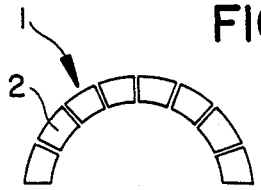
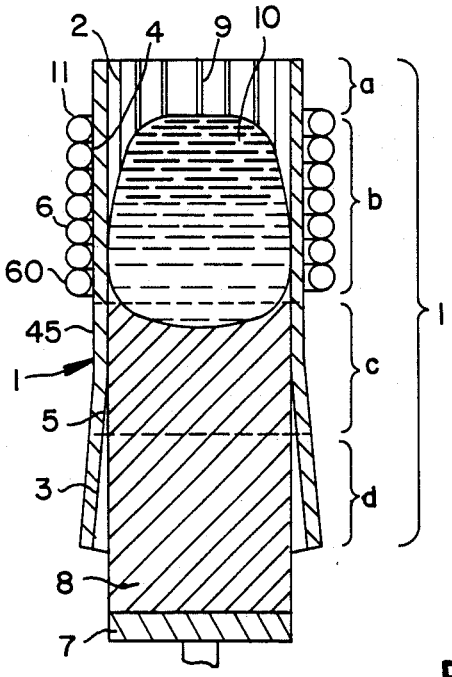
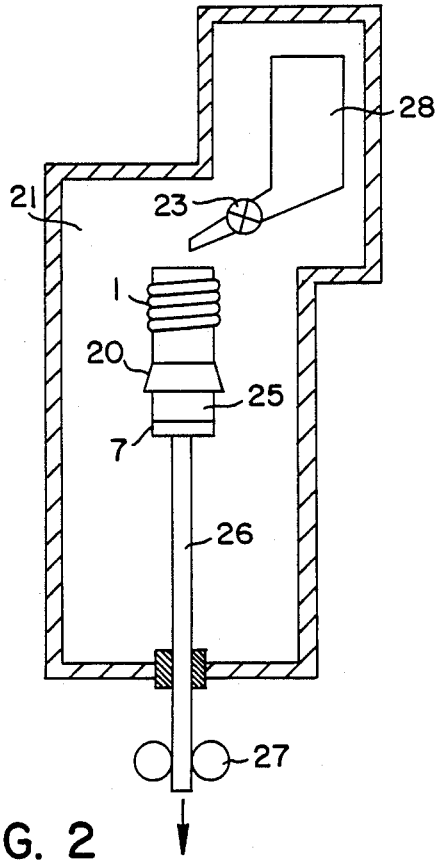
FIG. 2
FIG. 1b
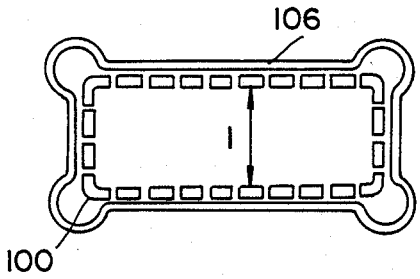
FIG. 3
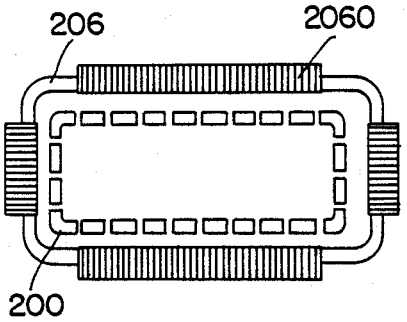
FIG. 4

APPARATUS FOR MELTING AND CONTINUOUS CASTING OF METALS, THE PROCESS INVOLVED AND USE OF THE APPARATUS

The invention relates to a vertical apparatus for melting and continuous casting of metals, of the type known as cold crucible induction heating.

The cold crucible has a conductive wall, often made of copper, comprising a plurality of longitudinal sectors, ranging in number from 4 to over 20. These are juxtaposed and electrically insulated from one another and have an internal circulation of cooling fluid running through them.

Thus the wall is kept at a temperature far lower than that of the molten material.

The crucible is surrounded, over part of its height, with a cooled coaxial helical inductor, with a medium or hight frequency alternating current flowing through it. The division of the crucible wall into sectors allows the alternating magnetic field of the inductor to induce currents in the metallic material to be treated, which heat the material and agitate it when it has melted.

In a first category of continuous casting apparatus with a cold crucible, the molten metal is progressively discharged through an aperture, generally at the bottom of the crucible. The apparatus is then used exclusively for heating, and solidification takes place in a separate ingot mould. Contamination of the metal by the wall may be avoided by the formation of a film of solidified slag in contact with the wall, forming a sheath around the liquid metal.

Another solution is electromagnetic confinement by means of an alternating magnetic field which develops forces causing the lateral surface of the molten material to be unstuck from the wall. These two methods are referred to in French Pat. No. 2497050 (=US Pat. No. 4432093).

In a second category of continuous casing apparatus with a cold crucible, metal is progressively discharged in the solid state, by drawing it downwards. Thus the apparatus heats (melts) the charge, cools (solidifies) it and extracts it. This is the case with U.S. Pat. No. 3775091.

The metal is never in contact with the vertical cylindrical crucible, firstly because it is subjected to electromagnetic confinement forces, and secondly because a layer of solidified slag is interposed between the metal (liquid or solid) and the wall over the full height of the apparatus. Here there are several drawbacks: firstly, the great length of contact between the solid material and the wall requires a strong tractive force and precautions to prevent material form being pulled off the crucible wall; and secondly, the layer of slag adhering the the ingot has to be peeled off before the ingot is converted. Finally, the slag is tricky to handle, is in danger of polluting the metal and corroding the crucible, and involves extra oven cleaning operations, for it vaporises when the work is done under vacuum, and makes it possible to obtain any shape of ingot other than cylindrical ones.

The invention relates to a apparatus of the second category and avoids these drawbacks.

The apparatus according to the invention, for continuously casting metal, comprising a vertical, conductive cold crucible with at least part of the height of its wall in the form of longitudinal sectors which are electrically insulated from one another and have a cooling fluid running through them; an inductor with coils helically surrounding the crucible over part of its height and supplied with alternating current both for heating and confining the metal; a system for drawing down the ingot; and possibly a chamber with a controlled atmosphere, separating at least the contents of the crucible from the external atmosphere, is characterised in that the crucible (1) has an upper zone divided into sectors, with parallel vertical generating lines, and a lower zone divided into sectors and joined to the upper zone, the generating lines of the lower zone spreading apart in a downward direction for the join between the two zones, and that the lowest coil of the inductor is at the level of that join.

Given electrical control of the inductor, this structure enables liquid material to be electromagnetically confined away form the wall, except within a very short portion, preferably not more than 1 cm in height, at the level where the 2 zones of the crucible join; here the lateral wall or skin of the metal is solidified in contact with the cold wall of the crucible. Below that level the thickness of the solidified metal increases until it takes in the whole cross-section of the ingot.

Because of the change in the cross-section of the crucible between the upper and the lower zones, the solid metal only touches the wall over the very small height indicated. This facilitates drawing of the ingot, there is not pollution of the solidified metal by the metal of the crucible, and virtually no danger of metal being pulled off the wall, so the ingot has good surface condition. The apparatus makes it possible to operate without slag and hence to simplify the feed system, to work easily under vacuum or in an inert atmosphere and to cut out the peeling operating before the ingot is worked. For the apparatus to operate correctly, there must be a zone of contact between the metal and the wall in order to form the skin of the ingot.

The surprising descovery has been made that, so long as the zone of contact is short, the electrical contact produced by the metal between the sectors of the crucible does not upset the electrical operation of the system. So the height of that zone is limited to less than 1 cm and preferably from 2 to 5 mm. The level of the lowest coil of the inductor is very important. If it is above the join between the two zones of the crucible, the height of the contact between metal and wall cannot be limited sufficiently and hence there will be electrical difficulties and difficulties in drawing out the ingot. On the other hand, if it is below the join there will be substantially more danger of the liquid metal running out a along the wall.

When the zone joining the cylindrical and conical parts of the crucible is curved and fairly short, the reference level for the lowest coil of the inductor is where the extensions of these two zones intersect.

The angle at which the oblique generating lines of the lower zone of the crucible are inclined to the vertical generating lines of the upper wall thereof, divided into sectors, depends on the coefficient of contraction of the material on solidification. It must be chosen so that the ingot remains as close as possible to the wall, so that it can continue to cool without touching it. An angle of from 1° to 5° and preferably of about 2° is generally chosen.

When the apparatus is operating in equilibrium, the quantity of metal contained in it is as constant as possible, since feed and extraction are precisely controlled. The top of the dome of liquid metal (the shape is due to electromagnetic confinement) is kept at a constant level, which depends on the electrical and magnetic characteristics of the system and the nature of the metal. The height chosen for the inductor is preferably such that its top coil is at the level of the top of the liquid dome. If the inductor is shorter, the dome will be unstable with the danger of contact between the metal and the wall in undesirable zones. It is advantageous for the upper zone of the crucible, which is divided into sectors, to extend beyond the top of the liquid dome a distance approximately equal to 1/6 of the internal transverse dimension of the crucible.

The internal transverse dimension is half the smallest dimension of the crucible. In the case of a circular cross-section it is the radius. In the case of an ellipse it is half the small axis. In the case of a square it is half of the side. In the case of a rectangle it is half the width. In the case of a complex section, finally, it is half the distance between the closest parallel segments or half the distance between the closest points with parallel tangents.

In an alternative embodiment, the crucible may be extended upwardly by a zone not divided into sectors. The total height of the crucible above the highest coil of the inductor is than at least equal to half the internal transverse dimension of the crucible. The internal transverse dimension is measured in the upper zone with vertical generating lines, surrounded by the inductor.

The lower zone of the crucible, which is divided into sectors, has a total height at least equal to half the internal transverse dimension of the crucible, in order to avoid a screening effect which would cause a drop in energy yield. Its wall is either entirely oblique at first then extended downwardly by a vertical portion.

In the latter case the height of the oblique potion is at least equal to $\frac{1}{4}$ of the internal transverse dimension of the crucible. The crucible may also be extended downwardly by a zone not divided into sectors, with a vertical or oblique cooled wall connected to the divided zone above it. Its height will preferably be between the internal transverse dimension of the crucible and half that dimension. Its main function is to continue cooling the ingot.

The wall of the crucible is made of a material which is a good heat and electrical conductor (e.g. copper or aluminium) so as to have a good energy yield.

Continuous casting without slag, according to the invention, which necessitates a zone of direct metal-wall contact over a short height, requires a joining angle between the liquid and the wall which will give poor wetting. In some cases the inner surface of the crucible then has to be provided with a surface coating, e.g. a metal coating, or given surface treatment so as to obtain excellent surface condition for the ingot.

The apparatus according to the invention is adapted to produce cylindrical ingots. It is also adapted to produce ingots of non-circular, e.g. polygonal cross-section without slag, if the inner wall of the upper zone of the crucible has a polygonal cylindrical shape. These ingots cannot be obtained in the presence of slag, since solidification of the slag in the corners prevents the section from being filled properly with metal.

Hence to obtain an effective value for the magnetic field, uniform along the inner wall of the crucible, the inductors have to be modified. In a first embodiment (FIG. 2), the distance between the inductor and the wall is varied near the corners in order to reduce field strength there. In a second embodiment (FIG. 4) the magnetic circuit is arranged in the straight portions of the cross-section of the crucible, for example by partially surrounding the inductor with magnetic steel sheets or ferrites, possibly cooled ones, to increase the field in these zones.

The apparatus of the invention, which is particularly advantageous for remelting and casting refractory metals from groups IV, V and VI and their alloys, may also be used for melting and casting other metals or alloys, particularly rare earths, aluminium, copper, silicon and nickel-based or cobalt-based alloys. It is further suitable for producing metal by a chemical reaction, particularly when the other product formed by the reaction is gaseous or volatile.

FIG. 1*a* and 1*b* are a cross-section and an axial section through a cooled crucible according to the invention.

FIG. 2 shows a semi-continuous melting and casting installation according to the invention, in a controlled atmosphere.

FIGS. 3 and 4 show diagrammatic cross-sections through polygonal crucibles with the appropriate inductors.

EXAMPLE 1

In FIG. 1*b* the electrical and fluid connections have not been shown. Reference 1 is a copper crucible of a circular section 180 mm high. The top 125 mm (a+b+c) comprise 16 hollow sectors 2, each substantially trapezoidal in cross-section (FIG. 1*a*) and cooled by internal circulation of water. The bottom 55 mm (d) comprise a skirt 3 which is also cooled by internal circulation of water (FIG. 1*b*).

The upper zone 4 of the crucible 1 is in the form of a cylinder 80 mm high with an internal diameter of 60 mm. The lower zone 5 is in the form of a truncated cone 100 mm high with a top angle of 4°. It is divide into sectors over a height c=45 mm, the rest of the height d=55 mm not being so divided.

The inductor 6 is a copper tube 1 mm thick with an internal diameter of 6 mm. It is wound in a spiral 85 mm in diameter over a height of 7 coils, the coils being substantially contiguous and insulated. 7 is the false bottom of the cylindrical part of the crucible, on which the solidified metal 8 of the ingot rests. The false bottom is pulled downwardly in a steady operation.

The unit is in an insulated chamber in argon at atmospheric pressure. Titanium chips are purified in it by remelting. When the process is started up the false bottom of titanium is positioned so that its upper surface is half way up the inductor. The electric power is gradually increased until the top part of the false bottom melts. The false bottom is pulled gently, titanium chips are fed in and the power is further increased to its nominal value.

When the top 9 of the liquid dome 10 reaches the level of the top 11 of the inductor 6, titanium chips are fed in at the normal operating rate, i.e. 200 g/min, and the false bottom 7 is pulled down at the rate of 1.6 cm/min. Throughout the operation the height of metal-wall contact is kept between 2 and 5 mm. In 32 minutes a 6.5 kg ingot is obtained, of the following composition:

$0_2$ 2000 ppm
C 230 ppm
$N_2$ 105 ppm
Cu<20 ppm
Ti remainder and with excellent surface condition.

FIG. 2 shows the semi-continuous casting installation used. The crucible 20 is placed inside the sealed chamber 21 in argon at atmospheric pressure. The means for introducing inert gas or putting the chamber under vacuum are not shown. The hopper 22 contains the material which is fed into the crucible throught the distributor 23. The false bottom 7 supporting the ingot 25 is linded to the rod 26 which is driven by the device 27 and passes through the wall of the chamber 21 under sealed conditions. Operation of the feed and extraction means is synchronised by a control system (not shown) controlled by laser measurement of the level of the dome of liquid metal in the crucible.

EXAMPLE 2

A crucible designed to treat zirconium waste has substantially the same dimensions as that in example 1 except for two features: the angle of the cone is 2.5° and the height of the lower conical skirt, not divided into sectors, is 70 mm.

The operating power is 35 kW at the inductor terminals, and the current has a frequency of 9 kHz. The operation takes place in argon at atmospheric pressure.

The mode of operation is the same as in example 1. The height of the metal-wall contact is 2 to 8 mm throughout the operation. In a state of equilibrium the feed rate of zirconium chips is 175 g/min and the pulling down speed is 1 cm/min. In 54 minutes 9.4 kg of ingot is obtained, with good surface condition, containing the following impurities:

$O_2$ 700 ppm
C 30 ppm
$N_2$ 80 ppm
Cu $<10$ ppm

EXAMPLE 3

A 16 sector copper crucible with an internal diameter of 100 mm and a total height of 280 mm is made to purity chips of titanium alloy TA6V. The sectors extend over 230 mm from the top. The upper part is cylindrical and 130 mm high; the lower part is frustoconial with an angle of 2° and a height of 100 mm divided into sectors.

The 10 coil inductor made of tubing with an external diameter of 8 mm and a thickness of 1 mm has a height of 85 mm and an internal diameter of 150 mm. The operation is carried out in argon at atmospheric pressure, with a power of 50 kW and a frequency of 3 kHz, a feed rate of 466 g/min and an extraction speed of 1.3 cm/min. The height of the metal/wall contact is kept between 5 and 10 mm. A 35 kg ingot is obtained in 75 minutes.

EXAMPLE 4 (FIG. 3)

Bars of rectangular section 75×18 mm are obtained from chips of TA6V alloy. The crucible 100 is rectangular, the sides are 75 mm and I=18 mm. The corresponding half internal transverse dimension is 9 mm. Its total height is 110 mm. From top to bottom it comprises a 65 mm high cylindrical portion divided into sectors, a 15 mm conical portion divided into sectors and a 30 mm conical portion not divided into sectors. The angle of the cone is 2°. the number of sectors is 18. The 6 coil inductor 1O6 is 50 mm high. It is made of the same copper tubing as the previous exampled. The space between the crucible and the inductor is 10 mm, except near the corners where it is larger. The operation is carried out in argon at atmospheric pressure with a power of 35 kW at the inductor terminals, a frequency of 100 kHz, a feed rate of 175 g/min and a drawing speed of 2.9 cm/min. The height of the metal-wall contact is between 5 and 10 mm. A 1.8 kg ingot is obtained in 11 minutes.

EXAMPLE 5 (FIG. 4)

This figure shows a modification of Example 4, in which the inductor 206, at substantially constant spacing with (sic) the sectors of the crucible 200 200, is surrounded by magnetic steel sheets 2060 over its straight portions, so as to increase the field in the corresponding zones.

We claim:

1. In an apparatus for continuously casting metals comprising a vertical, conductive, cold crucible having at least part of its wall in the form of longitudinal sectors which are electrically insulated from each other and are adapted for circulation of a cooling fluid therethrough; an inductor comprising helical coils surrounding the crucible over part of its height and adapted for connection to a source of alternating current for heating and confining the metal; and means for drawing down the cast metal; the improvement wherein said crucible comprises an upper zone divided into longitudinal sectors with surfaces having parallel vertical generating lines, and a lower zone joined to said upper zone and divided into longitudinal sectors with surfaces having generating lines diverging in a downward direction from the junction between the zones, the lowermost coil of said inductor being at the level of the junction between upper and lower zones.

2. The apparatus of claim 1, wherein the lower zone (5), divided into sectors and with generating lines diverging, is extended downwardly by a zone divided into sectors and with vertical generating lines, the height of the diverging portion being at least equal to $\frac{1}{4}$ of the internal transverse dimension of the crucible.

3. The apparatus of claim 2, wherein the lower zone (5) of the crucible, divided into sectors, is extended downwardly by a cooled zone (3) not divided into sectors.

4. The apparatus of claim 2, wherein the internal surface of the upper zone (4) of the crucible (1) is provided with a surface coating or is treated so as to obtain poor wetting of the surface by the liquid metal.

5. The apparatus of claim 1 or 2, wherein the angle of inclination of the oblique generating lines of the lower zone (5) of the crucible (1), divided into sectors, is from 1° to 5°.

6. The apparatus of claim 1 or 2, wherein the inner wall of the upper zone (4) of the crucible (1) is in circular cylindrical form, and wherein the inner wall of the lower zone (5), divided into sectors, is frustoconical.

7. The apparatus of claim 1 or 2, wherein the inner wall of the upper zone (4) of the crucible (1) is in polygonal cylindrical form.

8. In a method for continuously casting metal comprising feeding solid metal in a divided form at a predetermined rate into a crucible having a wall comprising longitudinal sectors electrically insulated from each other, inductively heating and melting said divided metal with a helical coil inductor surrounding said crucible, confining said melted metal in an electromagnetic field, circulating a cooling fluid within the walls of the crucible, and extracting the metal in a solidified state by drawing the molten metal downwardly at a rate corresponding to said feed rate, the improvement comprising dividing said crucible into an upper, longitudinally sectored zone having surfaces with parallel vertical generating lines, and a lower longitudinally sectored zone joined to said upper zone, having surface with downwardly diverging generating lines, locating said inductor with its lowermost coil at the level of the junction between said upper and lower zones, and electromagnetically confining said melted metal in a manner such that the metal contacts said wall, in the absence of slag, only over a limited height not exceeding 1 cm at the level of the junction between the upper and lower zones, thereby facilitating said drawing and improving the surface condition of the solidified metal

9. The method of claim 8 or 10 wherein the metal being cast is selected from the group consisting of refractory metals of groups IV, V and VI and their alloys, rare earth metals, aluminum, copper, silicon, nickel-based alloys and cobalt-based alloys.

10. The method of claim 8, wherein the height of contact of the melted metal with said wall is between 2 and 5 mm.

11. The method of claim 8 or 10, wherein the feed and extraction rates are controlled such that the liquid metal confined within said crucible is maintained at a substantially constant level corresponding to the top of said inductor.

* * * * *